US010706794B2

(12) United States Patent
Zhu

(10) Patent No.: US 10,706,794 B2
(45) Date of Patent: Jul. 7, 2020

(54) ADJUSTMENT METHOD AND DEVICE FOR GAMMA CIRCUIT

(71) Applicant: BOE TECHNOLOGY GROUP CO., LTD., Beijing (CN)

(72) Inventor: Wenxiu Zhu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 66 days.

(21) Appl. No.: 16/101,671

(22) Filed: Aug. 13, 2018

(65) Prior Publication Data

US 2019/0172404 A1 Jun. 6, 2019

(30) Foreign Application Priority Data

Dec. 6, 2017 (CN) ..... 2017 1 1277373

(51) Int. Cl.
*G09G 3/36* (2006.01)
*G09G 3/20* (2006.01)
*G09G 5/10* (2006.01)

(52) U.S. Cl.
CPC ..... *G09G 3/3607* (2013.01); *G09G 3/2003* (2013.01); *G09G 5/10* (2013.01); *G09G 2320/0233* (2013.01); *G09G 2320/0242* (2013.01); *G09G 2320/0276* (2013.01); *G09G 2320/0666* (2013.01); *G09G 2320/0673* (2013.01); *G09G 2360/16* (2013.01)

(58) Field of Classification Search
CPC ..... G09G 3/3607
See application file for complete search history.

(56) References Cited

U.S. PATENT DOCUMENTS

2005/0285828 A1* 12/2005 Inoue ..... G09G 3/3208 345/76
2015/0187303 A1* 7/2015 Choi ..... G09G 3/20 345/691

* cited by examiner

*Primary Examiner* — Gustavo Polo
(74) *Attorney, Agent, or Firm* — Calfee, Halter & Griswold LLP

(57) ABSTRACT

The present disclosure relates to an adjustment method and device for a gamma circuit. In the gamma correction of the present disclosure, the brightness of the sub-pixel of each color in the white light is determined according to the brightness and color coordinates of the white light and the color coordinates of the sub-pixel of each color, the correspondence relationship between the brightness of the sub-pixel of each color in the white light and the voltage values of the sub-pixel is established, the target value of the voltage of the sub-pixel of each color is found from the correspondence relationship according to the brightness of the sub-pixel of each color in the white light corresponding to any grayscale, and then the voltages of red, green and blue sub-pixels are adjusted to the target values.

8 Claims, 3 Drawing Sheets

| voltage of red sub-pixel/V | brightness $L_R$ of R in white light/nits | voltage of green sub-pixel/V | brightness $L_G$ of G in white light/nits | voltage of blue sub-pixel/V | brightness $L_B$ of B in white light/nits |
|---|---|---|---|---|---|
| 0 | xxx | 0 | xxx | 0 | xxx |
| 0.1 | xxx | 0.1 | xxx | 0.1 | xxx |
| 0.2 | xxx | 0.2 | xxx | 0.2 | xxx |
| ..... | xxx | ..... | xxx | ..... | xxx |
| 5.9 | xxx | 5.9 | xxx | 5.9 | xxx |
| 6 | xxx | 6 | xxx | 6 | xxx |
Fig. 3
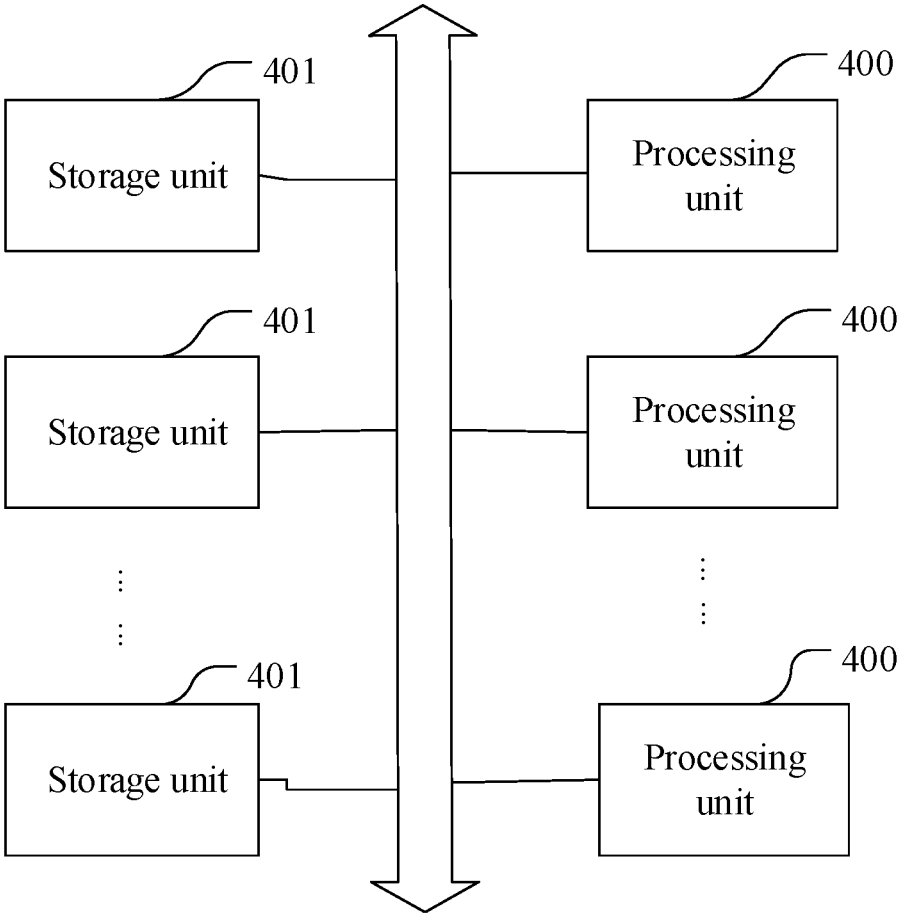
Fig. 4
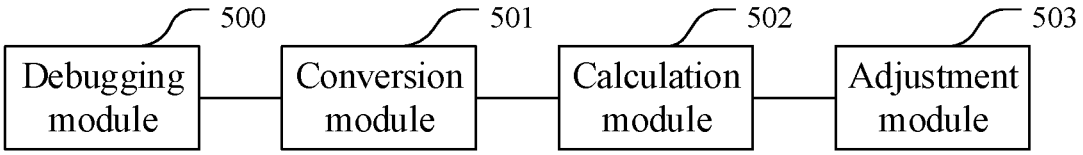
Fig. 5

ADJUSTMENT METHOD AND DEVICE FOR GAMMA CIRCUIT

CROSS-REFERENCE TO RELATED APPLICATIONS

This application claims priority to Chinese Patent Application 201711277373.3, filed Dec. 6, 2017, the entire contents of which are incorporated herein by reference.

TECHNICAL FIELD

The present disclosure relates to the display technical field, and in particular, to an adjustment method and device for a gamma circuit.

BACKGROUND

Currently, display devices have different electro-optical characteristics of red, green and blue colors on the display screen, resulting in a large difference in the color of each grayscale. Only when the colors of the grayscales are the same, the color temperature can be adjusted to the desired color temperature by the white balance adjustment of the bright and dark fields. Therefore, it is necessary to correct the color of each grayscale to clear the color error of each grayscale, so that the display can be adjusted by white balance. Clearing the color error of each grayscale can be achieved by gamma correction of the display.

SUMMARY

An embodiment of the present disclosure provides an adjustment method for a gamma circuit. The method includes:

determining the brightness and color coordinates of white light corresponding to voltage values of a sub-pixel set including a red sub-pixel, a green sub-pixel and a blue sub-pixel;

for a sub-pixel of each color in the sub-pixel set, determining color coordinates of the sub-pixel of the color corresponding to different voltage values of the sub-pixel of the color;

according to the determined brightness and the color coordinate of the white light and the determined color coordinates of the sub-pixel of each color, determining a correspondence relationship between the brightness of the sub-pixel of each color in the white light and the voltage value of the sub-pixel of each color;

for any grayscale, according to the brightness of the white light corresponding to the grayscale, determining the brightness of the sub-pixel of each color in the white light corresponding to the grayscale; and according to the determined correspondence relationship between the brightness of the sub-pixel of each color in the white light and the voltage values of the sub-pixel of each color, determining a target voltage value of the sub-pixel of each color corresponding to the brightness of the sub-pixel of each color in the white light which corresponds to the grayscale.

Another embodiment of the present disclosure provides an adjustment device for a gamma circuit, including:

at least one processing unit and at least one storage unit, wherein the storage unit has program codes stored therein, which when executed by the processing unit, cause the processing unit to perform:

determining the brightness and color coordinates of white light corresponding to voltage values of a sub-pixel set including a red sub-pixel, a green sub-pixel and a blue sub-pixel;

for a sub-pixel of each color in the sub-pixel set, determining color coordinates of the sub-pixel of the color corresponding to different voltage values of the sub-pixel of the color;

according to the determined brightness and the color coordinate of the white light and the determined color coordinates of the sub-pixel of each color, determining a correspondence relationship between the brightness of the sub-pixel of each color in the white light and the voltage value of the sub-pixel of each color;

for any grayscale, according to the brightness of the white light corresponding to the grayscale, determining the brightness of the sub-pixel of each color in the white light corresponding to the grayscale; and according to the determined correspondence relationship between the brightness of the sub-pixel of each color in the white light and the voltage values of the sub-pixel of each color, establishing a correspondence relationship between the brightness of the sub-pixel of each color in the white light and the voltage value of the sub-pixel of each color.

An embodiment of the present disclosure provides an adjustment circuit for a gamma circuit. The device includes:

a debugging module configured to determine the brightness and color coordinates of white light corresponding to voltage values of a sub-pixel set including a red sub-pixel, a green sub-pixel and a blue sub-pixel; for a sub-pixel of each color in the sub-pixel set, determine color coordinates of the sub-pixel of the color corresponding to different voltage values of the sub-pixel of the color;

a conversion module configured to, according to the determined brightness and the color coordinate of the white light and the determined color coordinates of the sub-pixel of each color, determine a correspondence relationship between the brightness of the sub-pixel of each color in the white light and the voltage value of the sub-pixel of each color;

a calculation module configured to, for any grayscale, according to the brightness of the white light corresponding to the grayscale, determine the brightness of the sub-pixel of each color in the white light corresponding to the grayscale; and an adjustment module configured to, according to the determined correspondence relationship between the brightness of the sub-pixel of each color in the white light and the voltage values of the sub-pixel of each color, determine a target voltage value of the sub-pixel of each color corresponding to the brightness of the sub-pixel of each color in the white light which corresponds to the grayscale.

BRIEF DESCRIPTION OF THE DRAWINGS

In order to more clearly explain the technical solutions in the embodiments of the present disclosure, the drawings will be briefly described below. Obviously, the drawings in the following description only show some exemplary embodiments of the present disclosure, and those of ordinary skill in the art can also obtain other drawings based on these drawings herein.

FIG. 3 is a schematic diagram showing another method for representing a correspondence relationship between the determined brightness of a sub-pixel of each color in white light and the voltage of the sub-pixel according to an embodiment of the present disclosure;

FIG. 4 is a schematic diagram showing a structure of an adjustment device for a gamma circuit according to an embodiment of the present disclosure; and FIG. 5 is a schematic diagram showing a structure of an adjustment device for a gamma circuit according to an embodiment of the present disclosure.

DETAILED DESCRIPTION

To make the objectives, technical solutions, and advantages of the present disclosure more comprehensible, the present disclosure will be further described in detail below with reference to the accompanying drawings. Obviously, the described embodiments are merely some but not all of the embodiments of the present disclosure. All other embodiments obtained by a person of ordinary skill in the art based on the embodiments of the present disclosure shall fall within the protection scope of the present disclosure.

Currently, in related arts, gamma correction is performed by adjusting the voltages of the red, green, and blue sub-pixels of the tie point to adjust the grayscale brightness and the color coordinates of the tie point to target values. During specific implementation of the gamma adjustment, after the grayscale brightness of the tie point is calculated based on the brightness of the white light in 255 grayscale, the voltages of the red and green sub-pixels of the 28 tie points are repeatedly adjusted in order to make the brightness and color coordinates of the tie point constantly move closer to the target values, eventually reach the set target values. The rest of the grayscales are obtained by interpolation.

When performing gamma correction in related arts, it is necessary to repeatedly adjust and test the voltages of the tie points, and in practical use, each gamma correction needs to debug a plurality of gamma curves to match the actual use. In addition, if you need different color coordinates for white light in use, you need to perform gamma correction again for each color coordinate. Therefore, the gamma correction process is cumbersome and takes a long time. Since in the gamma correction, adjustment and test are performed only on 28 tie points, and the rest of the grayscales are obtained by interpolation, there is also a problem of low accuracy.

In summary, the existing gamma correction technology is cumbersome, takes long time, and has a low accuracy.

Figure 1:
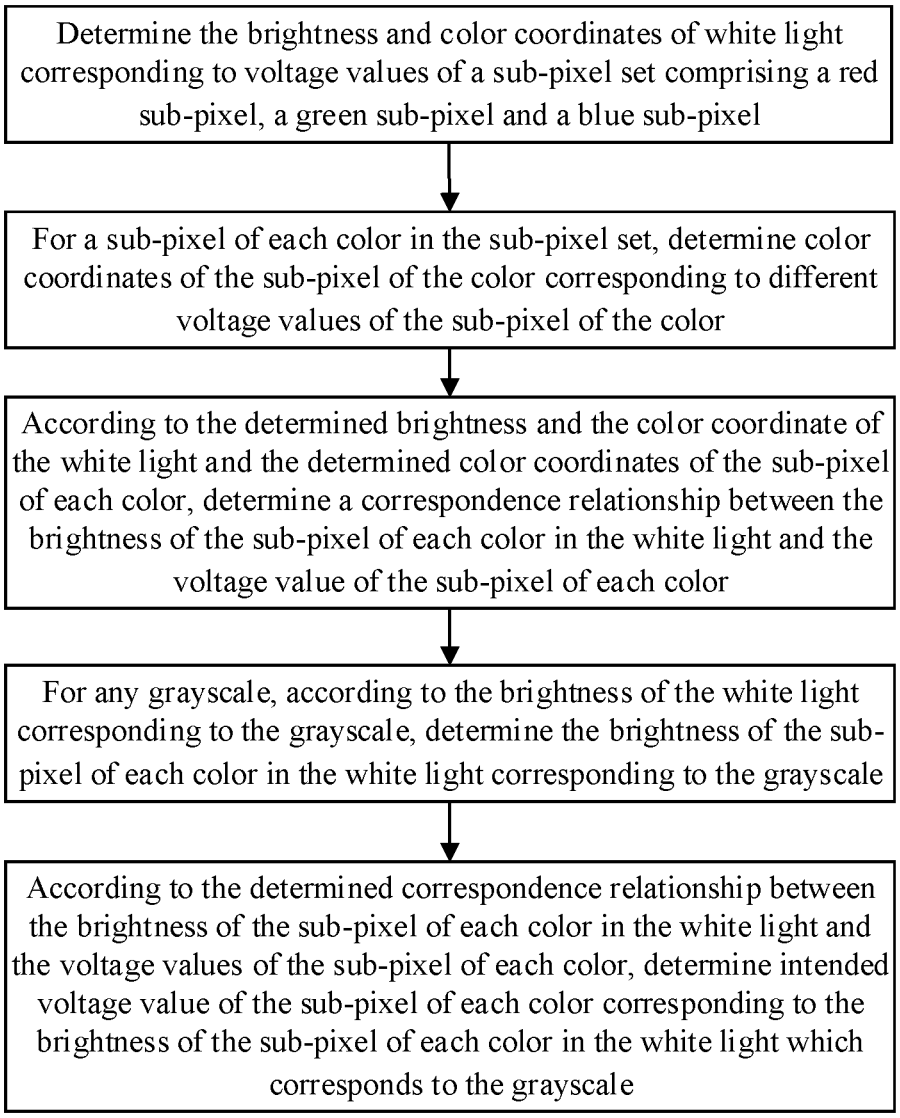
FIG. 1 is a flow chart of an adjustment method for a gamma circuit according to an embodiment of the present disclosure.

To solve the above problems, an embodiment of the present disclosure provides an adjustment method for a gamma circuit, as shown in FIG. 1. The method includes the following steps:

In step 100, the brightness and color coordinates of white light corresponding to voltage values of a sub-pixel set including a red sub-pixel, a green sub-pixel and a blue sub-pixel are determined.

In step 101, for a sub-pixel of each color in the sub-pixel set, color coordinates of the sub-pixel of the color corresponding to different voltage values of the sub-pixel of the color are determined.

In step 102, according to the determined brightness and the color coordinate of the white light and the determined color coordinates of the sub-pixel of each color, a correspondence relationship between the brightness of the sub-pixel of each color in the white light and the voltage value of the sub-pixel of each color is determined.

In step 103, for any grayscale, according to the brightness of the white light corresponding to the grayscale, the brightness of the sub-pixel of each color in the white light corresponding to the grayscale is determined.

In step 104, according to the determined correspondence relationship between the brightness of the sub-pixel of each color in the white light and the voltage values of the sub-pixel of each color, intended voltage value (i.e., the target voltage value which is to be adjusted to) of the sub-pixel of each color corresponding to the brightness of the sub-pixel of each color in the white light which corresponds to the grayscale is determined.

The target value of the sub-pixel of each color may be a digital value, and the digital value may be then converted by a Digital to Analog converter (D/A converter) into an analog voltage which is then input to sub-pixels in a display device to drive sub-pixels to emit light.

In the gamma correction provided in the present disclosure, first, test is performed to obtain the brightness and color coordinates of white light corresponding to voltage values of a sub-pixel set including a red sub-pixel, a green sub-pixel and a blue sub-pixel, and color coordinates of individual sub-pixels in the sub-pixel set corresponding to the voltage values of the sub-pixels. Then, according to the determined brightness and the color coordinate of the white light and the determined color coordinates of the sub-pixel of each color, the brightness of individual sub-pixels in the white light is determined, and a correspondence relationship between the brightness of the sub-pixel of each color in the white light and the voltage value of the sub-pixel of each color is established. Then, the brightness of the white light corresponding to each grayscale is determined, and the brightness of the sub-pixel of each color in the white light corresponding to each grayscale is determined. Then, according to the brightness of the sub-pixel of each color in the white light corresponding to each grayscale, a target value of the voltage of each sub-pixel (i.e., the voltage which needs to be adjusted to) corresponding to the brightness of each sub-pixel in the white light corresponding to the grayscale is found from the previously established correspondence relationship between the brightness of the sub-pixel of each color in the white light and the voltage value of the sub-pixel of each color. In related arts, tests are performed for tie points to achieve the target values of the brightness of the grayscales and the color coordinates of the grayscales of the tie points, and for other grayscales than the tie points, the target values are obtained by interpolation and fitting. In the gamma correction of the present disclosure, the voltage values (i.e., the target voltage values which are needed to adjusted to) of the sub-pixel of each color corresponding to the brightness of the sub-pixel of each color in the white light corresponding to each grayscale are determined firstly, and then perform adjustment to make the voltages of individual sub-pixels directly to the voltage values which are needed to be adjusted to, i.e., the target voltage values are achieved. The present disclosure does not need to adjust and test the voltages of the red and green sub-pixels in the red, green and blue sub-pixels many times, and the debugging procedure becomes simple and the time which needs to be taken can be shortened. Meanwhile, since the accurate values of the voltages of the sub-pixel of each color corresponding to each grayscale can be determined, the accuracy is high.

Each pixel on a general liquid crystal panel consists of three primary colors of red, green and blue (RGB), and each pixel of each color is called a sub-pixel.

In the specific implementation of gamma correction, first, brightness and color coordinates of white light corresponding to voltage values of different sub-pixel sets each of which includes a red sub-pixel, a green sub-pixel and a blue sub-pixel.

According to an exemplary embodiment, according to a pre-set voltage range and a step value for a red sub-pixel, a green sub-pixel and a blue sub-pixel, the voltage values of the red, green and blue sub-pixels are adjusted several times to obtain the voltage values of a plurality of sub-pixel sets each of which includes a red sub-pixel, a green sub-pixel, and a blue sub-pixel, wherein the voltage value of at least one of the red, green and blue sub-pixels is adjusted in each adjustment; after each adjustment, the brightness and the color coordinates of the white light are determined according to the adjusted voltage values of the red, green, and blue sub-pixels which correspond to the white light.

The voltage values of the red, green and blue sub-pixels are adjusted several times, and the voltage value of at least one color sub-pixel in the red, green and blue sub-pixels is adjusted at a time. After one adjustment, the voltage values of a set of red, green and blue sub-pixels are obtained. The brightness and color coordinates of the white light under the current voltage value of the sub-pixel of each color are tested after each adjustment, and according to the brightness of the white light and the color coordinates of the white light and the color coordinates of the sub-pixel of each color under the voltage value of the corresponding sub-pixel, the brightness of the sub-pixel of each color in white light under the voltage value of the current sub-pixel is determined. In this way, the voltage value of the sub-pixel of each color corresponding to the brightness of the sub-pixel in the white light corresponding to each grayscale can be found.

The voltage of at least one of the red, green and blue sub-pixels is adjusted during each adjustment of the voltage of the red, green and blue sub-pixels, so that voltage values of different sets of red, green and blue sub-pixels are obtained.

For example, assuming that the pre-set voltage range of each of the red, green, and blue sub-pixels is 0 to 6 V and the pre-set step value is 1 V, when test is performed, there may be 7*7*7=343 sets of voltage values of red, green and blue sub-pixels.

After each adjustment of the voltage values of the red, green, and blue sub-pixels, the brightness and color coordinates of the white light corresponding to the current voltage values of the sub-pixel set including a red sub-pixel, a green sub-pixel and a blue sub-pixel are tested. The voltage values of each set of red, green and blue sub-pixels correspond to the brightness and color coordinates of the white light one to one. Then, after the test, 343 sets of brightness and color coordinates of white light can be obtained for subsequent calculation and search.

In a specific implementation, when the brightness of the sub-pixel of each color in the synthesized white light is calculated by color combination, the color coordinate coefficients of the red, green and blue sub-pixels of the above white light also need to be synthesized. Thus, when the brightness and color coordinates of the white light corresponding to the current voltage values of the red, green and blue sub-pixels are tested, the color coordinates of the sub-pixel of each color under the current voltage values of the red, green and blue sub-pixels are also required to be tested.

According to an exemplary embodiment, for a sub-pixel of each color, the voltage value of the sub-pixel of each color is adjusted several times according to the pre-set voltage range and the step value for a red sub-pixel, a green sub-pixel and a blue sub-pixel; after each adjustment, the color coordinates corresponding to the sub-pixel of each color is determined using the adjusted voltage value of the sub-pixel.

The color coordinates of the sub-pixel of each color in the red, green and blue sub-pixels under different voltage values of the sub-pixel sets are measured, and the brightness of the sub-pixel of each color in the white light can be calculated by color combination in conjunction with the above brightness and color coordinates of the white light, and a correspondence relationship between the brightness of the sub-pixel of each color in the white light and the voltage values of the sub-pixels of corresponding colors in the white light which correspond to the measured brightness and color coordinates of the white light can be obtained. In this way, the brightness of each grayscale is calculated to obtain the brightness of the sub-pixel of each color in the white light corresponding to the grayscale, and then the voltage value of the sub-pixel of each color can be found from the correspondence relationship between the brightness of the sub-pixel of each color in the white light and the voltage value of the sub-pixel of each color which is established according to the brightness of the sub-pixel of each color in the white light determined under the voltage values of the sub-pixel sets each of which includes a red sub-pixel, a green sub-pixel and a blue sub-pixel.

For example, it is assumed that the voltages of the current red, green and blue sub-pixels are as follows: the voltage of the red sub-pixel is 1V, the voltage of the green sub-pixel is 2V, and the voltage of the blue sub-pixel is 1V. Then, the following values need to be tested: the brightness of the white light under the current voltage values of the red, green, and blue sub-pixels, the color coordinates of the white light under the current voltage values of the red, green, and blue sub-pixels, the color coordinates of the red light under the current voltage value of the red sub-pixel, the color coordinates of the green light under the current voltage value of the green sub-pixel, and color coordinates of the blue light under the current voltage value of the blue sub-pixel.

According to an exemplary embodiment, after each adjustment of the voltage values of the red, green and blue sub-pixels according to the pre-set voltage ranges and pre-set step lengths of the red, green, and blue sub-pixels, the brightness and color coordinates of the white light and the color coordinates of individual sub-pixels of respective colors are tested, and then the voltages of the red, green and blue sub-pixels are adjusted according to the pre-set voltage ranges and pre-set step lengths of the red, green, and blue sub-pixels. The voltage value of the sub-pixel of one color is adjusted in each adjustment.

After the brightness and the color coordinates of the white light under the voltage value of the sub-pixel of each color in each sub-pixel set and the color coordinates of the sub-pixel of each color are tested and the tested values are obtained, the tested values are used to perform color combination calculation to determine the brightness of the sub-pixel of each color in the white light corresponding to the voltage values of each set of red, green and blue sub-pixels.

According to an exemplary embodiment, when determining the correspondence relationship between the brightness of the sub-pixel of each color in the white light and the voltage values of the sub-pixel of each color according to the determined brightness and color coordinates of the white light and the determined color coordinates of the sub-pixel of each color, the following steps may be used to establish the correspondence relationship between the brightness of the sub-pixel of each color in the white light and the voltage value of the sub-pixel of each color.

First, the brightness of the sub-pixel of each color in the white light may be calculated by the color combination approach. The following three steps may be performed to calculate the brightness of the sub-pixel of each color in the white light by the color combination approach.

In a first step, for voltage values of any sub-pixel set including a red sub-pixel, a green sub-pixel and a blue sub-pixel, tri-stimulus values of the white light are determined according to the brightness and the color coordinates of the white light based on the voltage values of the sub-pixel set, and a column matrix of the tri-stimulus values of the white light is formed.

In a second step, according to the color coordinates of the sub-pixel of each color determined based on the voltage values of the sub-pixel set, color coordinate coefficients corresponding to the sub-pixel of each color are determined, and a matrix of the color coordinate coefficients of the red, green and blue sub-pixels is formed.

In a third step, a matrix multiplication calculation is performed on the column matrix of the tri-stimulus values of the white light and the matrix of the color coordinate coefficients of the red, green and blue sub-pixels, and the brightness of the sub-pixel of each color in the white light is determined.

In implementation, after determining the brightness of the sub-pixel of each color in white light, when establishing the correspondence relationship between the brightness of the sub-pixel of each color in the white light and the voltage value of the sub-pixel of each color, the following fourth step is used to establish the correspondence relationship between the brightness of the sub-pixel of each color in the white light and the voltage value of the sub-pixel of each color.

In a fourth step, for the sub-pixel of each color, according to the brightness of the sub-pixel of each color in the white light determined based on the voltage values of each sub-pixel set, the correspondence relationship between the brightness of the sub-pixel of each color in the white light and the voltage value of the sub-pixel of each color is established.

The three steps for determining the brightness of the sub-pixel of each color in the white light by the color combination approach will be described below.

In the first step, for voltage values of any sub-pixel set including a red sub-pixel, a green sub-pixel and a blue sub-pixel, tri-stimulus values of the white light are determined according to the brightness and the color coordinates of the white light based on the voltage values of the sub-pixel set, and a column matrix of the tri-stimulus values of the white light is formed.

In practical implementation, for voltage values of any sub-pixel set including a red sub-pixel, a green sub-pixel and a blue sub-pixel, the brightness and the color coordinates of the white light under the voltage values of the sub-pixel set are tested. The brightness of the white light is $L_W$, where W represents the white light. The color coordinates of the white light are (x, y). When calculating the tri-stimulus values of the white light, $$X = \frac{x}{y} \times L_W,\ Y = L_W,\ \text{and}\ Z = \frac{1-x-y}{y} \times L_W,$$

and then the column matrix of the tri-stimulus values of the white light is $$\begin{bmatrix} X \\ Y \\ Z \end{bmatrix},$$

where X is the red stimulus value in white light, Y is the green stimulus value in white light, and Z is the blue stimulus value in white light.

For example, it is assumed that in the specific implementation, the brightness of the white light is 350 nits, and the color coordinates are (0.3, 0.32), and then the tri-stimulus values of the white light are:

$$X = \frac{x}{y} \times L_W = 328;\ Y = L_W = 350;\ Z = \frac{1-x-y}{y} \times L_W = 415.6;$$

and the of the tri-stimulus values of the white light is $$\begin{bmatrix} 328 \\ 350 \\ 415.6 \end{bmatrix}.$$

After tri-stimulus values of the white light are calculated, the color coordinate coefficients of the red, green and blue sub-pixels need to be determined according to the measured color coordinates of the red, green and blue sub-pixels.

In the second step, the color coordinate coefficients are determined according to the color coordinates of the sub-pixel of any color, and the color coordinate coefficient matrix of the red, green and blue sub-pixels is formed.

The color coordinate coefficient matrix of the red, green and blue sub-pixels can be expressed as $$\begin{bmatrix} R_X & G_X & B_X \\ R_Y & G_Y & B_Y \\ R_Z & G_Z & B_Z \end{bmatrix};$$

where:

$R_X$ is the color coordinate coefficient of the red sub-pixel in the red stimulus value, $R_Y$ is the color coordinate coefficient of the red sub-pixel in the green stimulus value, and $R_Z$ is the color coordinate coefficient of the red sub-pixel in the blue stimulus value;

$G_X$ is the color coordinate coefficient of the green sub-pixel in the red stimulus value, $G_Y$ is the color coordinate coefficient of the green sub-pixel in the green stimulus value, and $G_Z$ is the color coordinate coefficient of the green sub-pixel in the blue stimulus value;

$B_X$ is the color coordinate coefficient of the blue sub-pixel in the red stimulus value, $B_Y$ is the color coordinate coefficient of the blue sub-pixel in the green stimulus value, and $B_Z$ is the color coordinate coefficient of the blue sub-pixel in the blue stimulus value.

The following describes an example of how to, for a sub-pixel of a color, calculate the color coordinate coefficient from the color coordinates of the sub-pixel of the color.

It is assumed that the color coordinates of the red sub-pixel are ($R_x$, $R_y$), the color coordinates of the green sub-pixel are ($G_x$, $G_y$), and the color coordinates of the blue sub-pixel are ($B_x$, $B_y$).

The color coordinate coefficients of the red sub-pixel are:

$$R_X = \frac{Rx}{Ry};\ R_Y = 1;\ R_Z = \frac{(1 - Rx - Ry)}{Ry}.$$

The color coordinate coefficients of the green sub-pixel are:

$$G_X = \frac{Gx}{Gy};\ G_Y = 1;\ G_Z = \frac{(1 - Gx - Gy)}{Gy}.$$

The color coordinate coefficients of the blue sub-pixels are:

$$B_X = \frac{Bx}{By};\ B_Y = 1;\ B_Z = \frac{(1 - Bx - By)}{By}.$$

For example, if the color coordinates of the red sub-pixel are (0.6701, 0.3291), the color coordinate coefficients of the red sub-pixel are calculated as:

$$R_X = \frac{Rx}{Ry} = 2.03;\ R_Y = 1;\ R_Z = \frac{(1 - Rx - Ry)}{Ry} = 0.0006.$$

If the color coordinates of the green sub-pixel are (0.2339, 0.7106), the color coordinate coefficients of the green sub-pixel are calculated as:

$$G_X = \frac{Gx}{Gy} = 0.3292;\ G_Y = 1;\ G_Z = \frac{(1 - Gx - Gy)}{Gy} = 0.0781;$$

If the color coordinates of the blue sub-pixel are (0.1378, 0.0502), the color coordinate coefficients of the blue sub-pixel are calculated as:

$$B_X = \frac{Bx}{By} = 2.7450;\ B_Y = 1;\ B_Z = \frac{(1 - Bx - By)}{By} = 16.1753.$$

After the matrix of the tri-stimulus values corresponding to the white light and the matrix of the color coordinate coefficients of red, green and blue sub-pixels are obtained, matrix multiplication transformation for the color combination is performed to obtain the brightness of each sub-pixel in the white light.

In the third step, a matrix multiplication calculation is performed on the column matrix of the tri-stimulus values of the white light and the matrix of the color coordinate coefficients of the red, green and blue sub-pixels, and the brightness of the sub-pixel of each color in the white light is determined.

The matrix multiplication formula is:

$$\begin{bmatrix} L_R \\ L_G \\ L_B \end{bmatrix} = \begin{bmatrix} R_X & G_X & B_X \\ R_Y & G_Y & B_Y \\ R_Z & G_Z & B_Z \end{bmatrix}^{-1} \cdot \begin{bmatrix} X \\ Y \\ Z \end{bmatrix};$$

where:

$$\begin{bmatrix} L_R \\ L_G \\ L_B \end{bmatrix}$$

is the brightness matrix of the sub-pixel of each color in white light, $L_R$ is the brightness of the red sub-pixel in white light, $L_G$ is the brightness of the green sub-pixel in white light, and $L_B$ is the brightness of the blue sub-pixel in the white light;

$$\begin{bmatrix} R_X & G_X & B_X \\ R_Y & G_Y & B_Y \\ R_Z & G_Z & B_Z \end{bmatrix}$$

is the color coordinate coefficient matrix of the red, green and blue sub-pixels;

$$\begin{bmatrix} X \\ Y \\ Z \end{bmatrix}$$

is the matrix of the tri-stimulus values of the white light.

The following is an example of how to determine the brightness of the sub-pixel of each color in the white light.

For example, it is assumed that the brightness of the white light is 350 nits, the color coordinates of the white light are (0.3, 0.32), the color coordinates of red sub-pixel are (0.6701, 0.3297), the color coordinates of green sub-pixel are (0.2339, 0.7106), and the color coordinates of blue sub-pixels are (0.1378, 0.0502).

Firstly, the matrix of the tri-stimulus values of the white light is determined according to the brightness of the white light and the color coordinates of the white light, where the brightness of the white light is 350 nits and the color coordinates are (0.3, 0.32):

$$X = \frac{0.3}{0.32} \times 350 = 328.1;\ Y = 350;\ Z = \frac{1 - 0.3 - 0.32}{0.32} \times 350 = 415.6.$$

Then, the matrix of the tri-stimulus values of the white light is:

$$\begin{bmatrix} 328 \\ 350 \\ 415.6 \end{bmatrix}.$$

Further, the color coordinate coefficients of the red sub-pixel, the green sub-pixel, and the blue sub-pixel need to be obtained from the color coordinates of the red sub-pixel, the green sub-pixel, and the blue sub-pixel so as to determine the matrix of the color coordinate coefficients of the red, green and blue sub-pixels.

The color coordinates of the red sub-pixel are (0.6701, 0.3297), and the color coordinate coefficients of the red sub-pixel are:

$$R_X = \frac{Rx}{Ry} = \frac{0.6701}{0.3297} = 2.0325;\ R_Y = 1;$$

$$R_Z = \frac{(1 - 0.6701 - 0.3297)}{0.3297} = 0.0006.$$

The color coordinates of the green sub-pixel are (0.2339, 0.7106), and the color coordinate coefficients of the green sub-pixel are:

$$G_X = \frac{Gx}{Gy} = 0.3292;\ G_Y = 1;\ G_Z = \frac{(1 - Gx - Gy)}{Gy} = 0.0781.$$

The color coordinates of the blue sub-pixel are (0.1378, 0.0502), and the color coordinate coefficients of the blue sub-pixel are:

$$B_X = \frac{Bx}{By} = 2.7450;\ B_Y = 1;\ B_Z = \frac{(1 - Bx - By)}{By} = 16.1753.$$

Finally, the obtained tri-stimulus values of the white light are substituted into the matrix of the tri-stimulus values of the white light, and the obtained color coordinate coefficients of the red, green, and blue sub-pixels are substituted into the corresponding matrix of the color coordinates of the red, green and blue sub-pixels, and the matrix multiplication transformation is performed to obtain the brightness of the sub-pixel of each color in the white light.

That is, the values obtained as described above are substituted into the formula:

$$\begin{bmatrix} L_R \\ L_G \\ L_B \end{bmatrix} = \begin{bmatrix} R_X & G_X & B_X \\ R_Y & G_Y & B_Y \\ R_Z & G_Z & B_Z \end{bmatrix}^{-1} \cdot \begin{bmatrix} X \\ Y \\ Z \end{bmatrix},$$

and then the following is obtained:

$$\begin{bmatrix} L_R \\ L_G \\ L_B \end{bmatrix} = \begin{bmatrix} R_X & G_X & B_X \\ R_Y & G_Y & B_Y \\ R_Z & G_Z & B_Z \end{bmatrix}^{-1} \cdot \begin{bmatrix} X \\ Y \\ Z \end{bmatrix} = \begin{bmatrix} 90.2 \\ 253.3 \\ 24.6 \end{bmatrix}.$$

The calculated brightness of the red sub-pixel in the white light is: $L_R$=90.2 nits.

The brightness of green sub-pixel in white light is: $L_G$=235.3 nits.

The brightness of the blue sub-pixel in white light is $L_B$=24.6 nits.

The above calculation process determines the brightness of the sub-pixel of each color sub-pixel in the white light by the color combination approach. After determining the brightness of the sub-pixel of each color in white light under the voltage values of each set of red, green and blue sub-pixels, the correspondence relationship between the brightness of the sub-pixel of each color in the white light and the voltage value of the sub-pixel of each color is determined by using the following fourth step.

In the fourth step, for the sub-pixel of each color, according to the brightness of the sub-pixel of each color in the white light determined based on the voltage values of each sub-pixel set, the correspondence relationship between the brightness of the sub-pixel of each color in the white light and the voltage value of the sub-pixel of each color is established.

For the sub-pixel of any color, after the brightness of the sub-pixel of the color in the white light is obtained through matrix multiplication transformation, according to the brightness of the sub-pixel of each color in the white light determined under the voltage values of each sub-pixel set which includes red, green and blue subpixels, the correspondence relationship between the brightness of the sub-pixel of each color in the white light and the voltage value of the sub-pixel of each color is established. In this way, after determining the brightness of the sub-pixel of the color in the white light corresponding to any grayscale, the voltage value of the sub-pixel of a color which corresponding to the brightness of the sub-pixel in the white light which correspond to a grayscale from the correspondence relationship. Because there is a one-to-one correspondence relationship between the brightness of the sub-pixel of the color in the white light and the voltage of the sub-pixel of the color, when gamma correction is performed, the required voltage value of each of the red, green and blue sub-pixels can be found quickly.

The correspondence relationship between the brightness of the sub-pixel of each color in the white light and the voltage value of the sub-pixel is illustrated below.

For example, it is assumed that in the current set of voltage values of the red, green and blue sub-pixels, the voltages of the red, green and blue sub-pixels are as follows: the voltage of the red sub-pixel is 4V, the voltage of the green sub-pixel is 3.9V, and the voltage of the blue sub-pixel is 5.1V.

The brightness of the sub-pixel of each color in the white light measured at the current voltages of the red, green and blue sub-pixels are as follows: the brightness of the red sub-pixel in the white light is 100 nits, the brightness of the green sub-pixel in the white light is 220 nits, and the brightness of the blue sub-pixel in the white light is 30 nits.

Then, the correspondence relationship between the brightness of the sub-pixel of each color in the white light and the voltage value of the sub-pixel is as follows:

when the brightness of the red sub-pixel in white light is 100 nits, the voltage of the red sub-pixel is 4V;

when the brightness of the green sub-pixel in white light is 220 nits, the voltage of the green sub-pixel is 3.9V;

when the brightness of the blue sub-pixel in white light is 30 nits, the voltage of the blue sub-pixel is 5.1V.

For a sub-pixel of any color, after the brightness of the sub-pixel of the color in the white light is obtained after the matrix transformation, according to the brightness of the sub-pixel of the color in the white light which is determined under the voltage values of a sub-pixel set which includes red, green and blue sub-pixels, the correspondence relationship between the brightness of the sub-pixel of each color in the white light and the voltage value of the sub-pixel is established. Here, the correspondence relationship between the brightness of the sub-pixel of each color in the white light and the voltage value of the sub-pixel can be represented in many ways, such as in charts, in curves in a coordinate graph and so on.

Figure 2:
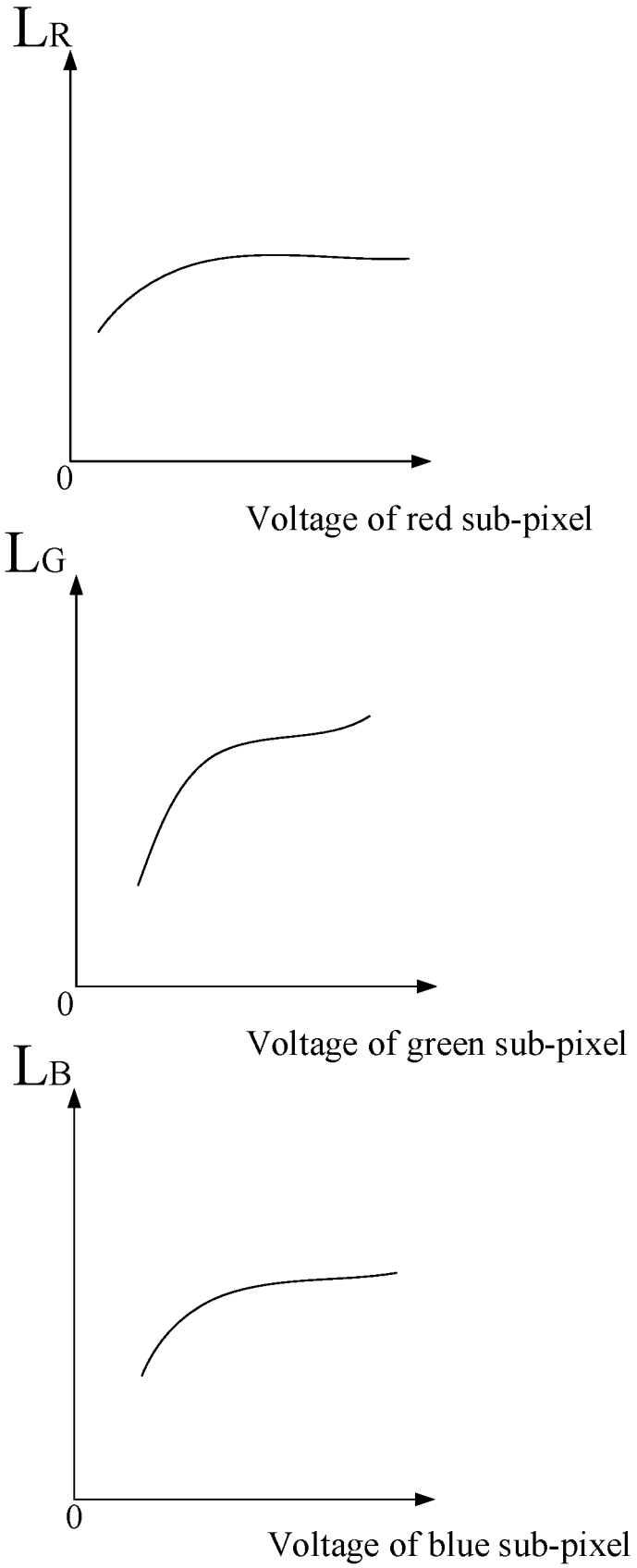
FIG. 2 is a schematic diagram showing a method for representing a correspondence relationship between the determined brightness of a sub-pixel of each color in white light and the voltage of the sub-pixel according to an embodiment of the present disclosure.

For example, as shown in FIG. 2, the voltages of the red sub-pixel (R), the green sub-pixel (G), and the blue sub-pixel (B) are respectively plotted on the abscissa, and the brightness $L_R$ of the red sub-pixel, the brightness $L_G$ of the green sub-pixel and the brightness $L_B$ of the blue sub-pixel are plotted on the ordinate to form three orthogonal graphs to represent the correspondence relationship between the brightness of the sub-pixel of each color in the white light and the voltage value of the sub-pixel.

As shown in FIG. 3, the brightness of sub-pixels of individual colors in the white light and the voltage values of the sub-pixels of corresponding color are combined into one list or one table, and the correspondence relationship between the brightness of the sub-pixel of each color in the white light and the voltage value of the sub-pixel is presented in a list or a table.

After the correspondence relationship between the brightness of the sub-pixel of each color in the white light and the voltage value of the sub-pixel is found, gamma correction is performed on each grayscale by using the found correspondence relationship.

At this time, firstly, for each grayscale, the brightness of the white light corresponding to the grayscale is determined by gamma calculation.

Specifically, for any grayscale, according to the grayscale, the brightness of the white light corresponding to the highest grayscale and a preset gamma value, the brightness of the white light corresponding to the grayscale is determined.

In implementation, the brightness of the white light corresponding to the current grayscale is deduced from the current grayscale, the pre-set gamma value, and the brightness of the white light corresponding to the highest grayscale. In this way, the grayscale brightness can be converted to the brightness of white light, and matrix multiplication transformation is performed on the color coordinate coefficient matrix of the sub-pixel of each color corresponding to the current and further grayscale to obtain the brightness of the sub-pixel of each color in the white light corresponding to the current grayscale. Then, from the above obtained correspondence relationship between the brightness of the sub-pixel of each color in the white light and the voltage value of the sub-pixel, the voltage values of the sub-pixels of individual colors as required by the current grayscale can be found, and thereby the gamma correction can be performed accurately.

In the following, an example of how to calculate the brightness of the white light corresponding to the current grayscale by using the current grayscale, the pre-set gamma value, and the brightness of the white light corresponding to the highest grayscale will be described.

For example, if the pre-set gamma value is 2.2, and the brightness of the white light corresponding to the grayscale of 255 is 350 nits, the brightness of the white light corresponding to a grayscale can be calculated using the following formula:

$$L_{gray} = \left(\frac{\text{Gray}}{255}\right)^{2.2} \times L_{255};$$

where $L_{gray}$ is the brightness of the current grayscale, Gray is the current grayscale, $L_{255}$ is the brightness of the white light corresponding to the grayscale of 255.

Assuming that the current grayscale is 200, the brightness of the white light corresponding to the current grayscale is:

$$L_{200} = \left(\frac{200}{255}\right)^{2.2} \times 350 = 205nits.$$

Assuming that the current grayscale is 150, the brightness of the white light corresponding to the current grayscale is:

$$L_{150} = \left(\frac{1.50}{2.55}\right)^{2.2} \times 350 = 108nits.$$

Through the above gamma calculation, it is possible to accurately determine the brightness of the white light corresponding to any one grayscale. In this way, after the subsequent white light matrix multiplication transformation, the brightness of the sub-pixel of any color in the white light corresponding to any grayscale and the voltage values of the sub-pixel can be found. In this way, the gamma correction can be more accurate.

After obtaining the brightness of the white light corresponding to a desired grayscale, color combination calculation can be performed on the brightness of the white light corresponding to the desired grayscale so as to determine the brightness of the sub-pixel of each color in the white light. And, according to the previously obtained correspondence relationship between the brightness of the sub-pixel of each color in the white light and the voltage value of the sub-pixel of each color, the target values of the voltages of the sub-pixels of individual colors may be determined when another gamma correction is needed based on the current gamma correction.

According to an exemplary embodiment, according to the brightness of the white light corresponding to the grayscale, pre-set color coordinates of the grayscale, and the determined color coordinate coefficients of the sub-pixel of each color corresponding to the grayscale, the matrix multiplication is performed to determine the brightness of the sub-pixel of each color in the white light corresponding to the grayscale.

At this time, the brightness of the white light corresponding to the grayscale which is obtained by calculation is $L_{gray}$, Gray represents the current grayscale, and the color coordinates of the white light corresponding to the current grayscale are (x1, y1). Then, the tri-stimulus values of the white light corresponding to the grayscale are calculated as:

$$X1 = \frac{x1}{y1} \times L_{gray};\ Y1 = L_{gray};\ Z1 = \frac{1 - x1 - y1}{y1} \times L_{gray};$$

then the matrix of the tri-stimulus values of the white light corresponding to the grayscale is $$\begin{bmatrix} X1 \\ Y1 \\ Z1 \end{bmatrix};$$

where X1 is the red stimulus value in white light corresponding to the grayscale, Y1 is the green stimulus value in white light corresponding to the grayscale, Z1 is the blue stimulus value in white light corresponding to the grayscale.

For example, when the brightness of the white light corresponding to the grayscale is 200 nits and color coordinates are (0.3, 0.32), the matrix of the tri-stimulus values of the white light corresponding to the grayscale are:

$$X1 = \frac{x1}{y1} \times L_{gray} = \frac{0.3}{0.32} \times 200 = 187.5;$$

$$Y1 = L_{gray} = 200;$$

$$Z1 = \frac{1 - x1 - y1}{y1} \times L_{gray} = \frac{1 - 0.3 - 0.32}{0.32} \times 200 = 237.5;$$

and the matrix of the tri-stimulus values of the white light corresponding to the grayscale is $$\begin{bmatrix} 187.5 \\ 200 \\ 237.5 \end{bmatrix}.$$

The pre-set color coordinates of the grayscale are the color coordinates of the white light corresponding to the grayscale.

After obtaining the tri-stimulus values of the white light corresponding to the grayscale, color coordinate coefficients of the sub-pixel of each color corresponding to the grayscale can be determined according to the color coordinates of the sub-pixel of each color corresponding to the grayscale.

The matrix of the color coordinate coefficients of the red, green and blue sub-pixels corresponding to the grayscale may be as follows:

$$\begin{bmatrix} R_{X1} & G_{X1} & B_{X1} \\ R_{Y1} & G_{Y1} & B_{Y1} \\ R_{Z1} & G_{Z1} & B_{Z1} \end{bmatrix};$$

where:

$R_{X1}$ is the color coordinate coefficient of the red sub-pixel in the red stimulus value of the white light corresponding to the grayscale, $R_{Y1}$ is the color coordinate coefficient of the red sub-pixel in the green stimulus value of the white light corresponding to the grayscale, and $R_{Z1}$ is the color coordinate coefficient of the red sub-pixel in the blue stimulus value of the white light corresponding to the grayscale;

$G_{X1}$ is the color coordinate coefficient of the green sub-pixel in the red stimulus value of the white light corresponding to the grayscale, $G_{Y1}$ is the color coordinate coefficient of the green sub-pixel in the green stimulus value of the white light corresponding to the grayscale, and $G_{Z1}$ is the color coordinate coefficient of the green sub-pixel in the blue stimulus value of the white light corresponding to the grayscale;

$B_{X1}$ is the color coordinate coefficient of the blue sub-pixel in the red stimulus value of the white light corresponding to the grayscale, $B_{Y1}$ is the color coordinate coefficient of the blue sub-pixel in the green stimulus value of the white light corresponding to the grayscale, and $B_{Z1}$ is the color coordinate coefficient of the blue sub-pixel in the blue stimulus value of the white light corresponding to the grayscale.

After obtaining the matrix of the tri-stimulus values of the white light corresponding to the grayscale and the matrix of the color coordinate coefficients of the red, green and blue sub-pixel corresponding to the grayscale, the matrix multiplication transformation for color combination is performed to obtain the brightness of the sub-pixel of each color in the white light corresponding to the grayscale.

The matrix multiplication formula is:

$$\begin{bmatrix} L_{R1} \\ L_{G1} \\ L_{B1} \end{bmatrix} = \begin{bmatrix} R_{X1} & G_{X1} & B_{X1} \\ R_{Y1} & G_{Y1} & B_{Y1} \\ R_{Z1} & G_{Z1} & B_{Z1} \end{bmatrix}^{-1} \cdot \begin{bmatrix} X1 \\ Y1 \\ Z1 \end{bmatrix};$$

where:

$$\begin{bmatrix} L_{R1} \\ L_{G1} \\ L_{B1} \end{bmatrix}$$

is the matrix of brightness of the sub-pixel of each color in the white light corresponding to the grayscale, $L_{R1}$ is the brightness of the red sub-pixel in the white light corresponding to the grayscale, and $L_{G1}$ is the brightness of the green sub-pixel in the white light corresponding to the grayscale, $L_{B1}$ is the brightness of the blue sub-pixel in the white light corresponding to the grayscale;

$$\begin{bmatrix} R_{X1} & G_{X1} & B_{X1} \\ R_{Y1} & G_{Y1} & B_{Y1} \\ R_{Z1} & G_{Z1} & B_{Z1} \end{bmatrix}$$

is the matrix of the color coordinate coefficients of the red, green and blue sub-pixels corresponding to the grayscale;

$$\begin{bmatrix} X1 \\ Y1 \\ Z1 \end{bmatrix}$$

is the matrix of the tri-stimulus values of the white light corresponding to the grayscale.

After obtaining the brightness of the sub-pixel of each color in the white light corresponding to the current grayscale, the brightness of the sub-pixel of each color in the white light corresponding to the current grayscale is determined by using the color combination approach, the calculation procedure is the same as the calculation procedure for determining the brightness of the sub-pixel of each color in the white light.

The color combination calculation will be described below with an example in which the brightness of the white light corresponding to the grayscale is 200 nits and color coordinates of the white light are (0.3, 0.32). It is assumed that the color coordinates of the red sub-pixel are (0.6701, 0.3297), the color coordinates of the green sub-pixel are (0.2339, 0.7106), and the color coordinates of the blue sub-pixel are (0.1378, 0.0502).

Firstly, a matrix of the tri-stimulus values of the white light is determined according to the brightness and color coordinates of the white light corresponding to the current grayscale as follows (the brightness of the white light is 350 nits and the color coordinates are (0.3, 0.32):

$$X1 = \frac{0.3}{0.32} \times 350 = 328.1;\ Y1 = 350;\ Z1 = \frac{1 - 0.3 - 0.32}{0.32} \times 350 = 415.6;$$

The matrix of the tri-stimulus values of the white light corresponding to the current grayscale is $$\begin{bmatrix} 328.1 \\ 350 \\ 415.6 \end{bmatrix}.$$

Further, the color coordinate coefficients of the red sub-pixel, green, and blue sub-pixels need to be obtained from the color coordinates of the red, green, and blue sub-pixels, so as to determine the matrix of the color coordinate coefficients of the red, green and blue sub-pixels corresponding to the current grayscale.

The color coordinates of the red sub-pixel are (0.6701, 0.3297), and the color coordinate coefficients of the red sub-pixel are:

$$R_X = \frac{Rx}{Ry} = \frac{0.6701}{0.3297} = 2.0325;$$

$$R_Y = 1;$$

$$R_Z = \frac{(1 - 0.6701 - 0.3297)}{0.3297} = 0.0006.$$

The color coordinates of the green sub-pixel are (0.2339, 0.7106), and the color coordinate coefficients of the green sub-pixel are:

$$G_X = \frac{Gx}{Gy} = 0.3292;\ G_Y = 1;\ G_Z = \frac{(1 \cdot Gx \cdot Gy)}{Gy} = 0.0781.$$

The color coordinates of the blue sub-pixel are (0.1378, 0.0502), and the color coordinate coefficients of the blue sub-pixel are:

$$B_X = \frac{Bx}{By} = 2.7450;\ B_Y = 1;\ B_Z = \frac{(1 \cdot Bx \cdot By)}{By} = 16.1753.$$

Finally, the obtained tri-stimulus values of the white light corresponding to the current grayscale are substituted into the matrix of the tri-stimulus values of the white light corresponding to the current grayscale, the obtained color coordinate coefficients of the red, green and blue sub-pixels corresponding to the current grayscale are substituted into the matrix of the color coordinates of the red, green and blue sub-pixels corresponding to the current grayscale, and the brightness of the sub-pixel of each color in the white light is determined by using the color combination approach.

That is, the above obtained values are substituted into the formula:

$$\begin{bmatrix} L_{R1} \\ L_{G1} \\ L_{B1} \end{bmatrix} = \begin{bmatrix} R_{X1} & G_{X1} & B_{X1} \\ R_{Y1} & G_{Y1} & B_{Y1} \\ R_{Z1} & G_{Z1} & B_{Z1} \end{bmatrix}^{-1} \cdot \begin{bmatrix} X1 \\ Y1 \\ Z1 \end{bmatrix},$$

and then the following is obtained:

$$\begin{bmatrix} L_{R1} \\ L_{G1} \\ L_{B1} \end{bmatrix} = \begin{bmatrix} R_{X1} & G_{X1} & B_{X1} \\ R_{Y1} & G_{Y1} & B_{Y1} \\ R_{Z1} & G_{Z1} & B_{Z1} \end{bmatrix}^{-1} \cdot \begin{bmatrix} X1 \\ Y1 \\ Z1 \end{bmatrix} = \begin{bmatrix} 51.5 \\ 134.4 \\ 14 \end{bmatrix}.$$

The calculated brightness of the red sub-pixel in the white light corresponding to the current grayscale is: $L_{R1}$=51.5 nits.

The brightness of the green sub-pixel in the white light corresponding to the current grayscale is: $L_{G1}$=134.4 nits.

The brightness of the blue sub-pixel in the white light corresponding to the current grayscale is: $L_{B1}$=14 nits.

In the specific implementation, the calculation such as the color combination may be completed manually, or may be calculated quickly by an integrated chip including a corresponding algorithm. Completing the calculation task by the integrated chip can effectively shorten the calculation time and improve the gamma correction efficiency.

In this way, according to the above algorithm, the brightness of the white light corresponding to all grayscales can be determined, and accordingly the brightness of the sub-pixel of each color in the white light corresponding to all grayscales can be determined. Consequently, from the previously obtained correspondence relationship between the brightness of the sub-pixel of each color in the white light and the voltage value of the sub-pixel of each color, the target value of the voltage of the sub-pixel of each color when performing gamma correction for each grayscale can be found.

After finding the voltage value of the sub-pixel of each color corresponding to each grayscale, the voltage of the sub-pixel of each color corresponding to each grayscale is adjusted according to the obtained voltage value of the sub-pixel of each color. After the voltage of the sub-pixel of each color corresponding to all grayscales is adjusted to the target value, this gamma correction is completed.

In the embodiments of the present disclosure, the voltage value of the sub-pixel of each color which is needed to be adjusted to during the gamma adjustment can be found for any grayscale by calculations, and it is not needed to adjust the voltage values of the red and green sub-pixels of each tie point for many times to make the color coordinates and brightness of the tie point corresponding to each grayscale close to the target values. In the present disclosure, according to the accurate values obtained by calculations, the voltage values of the sub-pixels of individual colors are adjusted directly to the target values. The adjustment steps are simplified, and the accuracy of the gamma correction is improved.

Based on the same inventive concept, an embodiment of the present disclosure provides an adjustment device for a gamma circuit. The principle for the device embodiments of the present to solve the technical problem is the same as that of the method embodiments which have been described above, and thus repeated descriptions are omitted here.

FIG. 4 is a schematic diagram showing an adjustment for a gamma circuit according to an embodiment of the present disclosure. As shown in FIG. 4, the device includes at least one processing unit 400 and at least one storage unit 401.

The storage unit has program codes stored therein, which when executed by the processing unit, cause the processing unit to perform the follow procedure:

determining the brightness and color coordinates of white light corresponding to voltage values of a sub-pixel set including a red sub-pixel, a green sub-pixel and a blue sub-pixel; for a sub-pixel of each color in the sub-pixel set, determining color coordinates of the sub-pixel of the color corresponding to different voltage values of the sub-pixel of the color; according to the determined brightness and the color coordinate of the white light and the determined color coordinates of the sub-pixel of each color, determining a correspondence relationship between the brightness of the sub-pixel of each color in the white light and the voltage value of the sub-pixel of each color; for any grayscale, according to the brightness of the white light corresponding to the grayscale, determining the brightness of the sub-pixel of each color in the white light corresponding to the grayscale; and according to the determined correspondence relationship between the brightness of the sub-pixel of each color in the white light and the voltage values of the sub-pixel of each color, determining a target voltage value of the sub-pixel of each color corresponding to the brightness of the sub-pixel of each color in the white light which corresponds to the grayscale.

According to an exemplary embodiment, the processing unit 400 is configured to perform:

when determining the brightness and color coordinates of white light corresponding to voltage values of a sub-pixel set including a red sub-pixel, a green sub-pixel and a blue sub-pixel, according to a pre-set voltage range and a step value for a red sub-pixel, a green sub-pixel and a blue sub-pixel, adjusting the voltage values of the red, green and blue sub-pixels several times to obtain the voltage values of a plurality of sub-pixel sets each of which includes a red sub-pixel, a green sub-pixel, and a blue sub-pixel, wherein the voltage value of at least one of the red, green and blue sub-pixels is adjusted in each adjustment; after each adjustment, determining the brightness and the color coordinates of the white light according to the adjusted voltage values of the red, green, and blue sub-pixels which correspond to the white light; when determining color coordinates of the sub-pixel of the color corresponding to different voltage values of the sub-pixel of the color for a sub-pixel of each color in the sub-pixel set, adjusting the voltage value of the sub-pixel of each color several times according to the pre-set voltage range and the step value for a red sub-pixel, a green sub-pixel and a blue sub-pixel; after each adjustment, determining the color coordinates corresponding to the sub-pixel of each color using the adjusted voltage value of the sub-pixel.

According to an exemplary embodiment, the processing unit 400 is the processing unit is configured to perform:

when determining a correspondence relationship between the brightness of the sub-pixel of each color in the white light and the voltage value of the sub-pixel of each color according to the determined brightness and the color coordinate of the white light and the determined color coordinates of the sub-pixel of each color, for voltage values of any sub-pixel set including a red sub-pixel, a green sub-pixel and a blue sub-pixel, determining tri-stimulus values of the white light according to the brightness and the color coordinates of the white light based on the voltage values of the sub-pixel set, and forming a column matrix of the tri-stimulus values of the white light; according to the color coordinates of the sub-pixel of each color determined based on the voltage values of the sub-pixel set, determining color coordinate coefficients corresponding to the sub-pixel of each color, and forming a matrix of the color coordinate coefficients of the red, green and blue sub-pixels; performing a matrix multiplication calculation on the column matrix of the tri-stimulus values of the white light and the matrix of the color coordinate coefficients of the red, green and blue sub-pixels, and determining the brightness of the sub-pixel of each color in the white light; and for the sub-pixel of each color, according to the brightness of the sub-pixel of each color in the white light determined based on the voltage values of each sub-pixel set, establishing the correspondence relationship between the brightness of the sub-pixel of each color in the white light and the voltage value of the sub-pixel of each color.

According to an exemplary embodiment, the processing unit 400 is configured to perform:

when determining the brightness of the sub-pixel of each color in the white light corresponding to the grayscale for any grayscale according to the brightness of the white light corresponding to the grayscale, determining the brightness of white light corresponding to the grayscale; according to the brightness of white light corresponding to the grayscale, pre-set color coordinates of the grayscale, and the color coordinate coefficients of the sub-pixel of each color corresponding to the grayscale, determining the brightness of the sub-pixel of each color in the white light corresponding to the grayscale by performing a matrix multiplication calculation.

According to an exemplary embodiment, the processing unit 400 is configured to perform:

determining the brightness of the white light corresponding to the grayscale according to the following manner:

for any grayscale, according to the grayscale, the brightness of the white light corresponding to the highest grayscale and a pre-set gamma value, determining the brightness of the white light corresponding to the grayscale.

As shown in FIG. 5, an embodiment of the present disclosure provides an adjustment for a gamma circuit. The device includes a debugging module 500, a conversion module 501, calculation module 502 and an adjustment module 503.

The debugging module 500 is configured to determine the brightness and color coordinates of white light corresponding to voltage values of a sub-pixel set including a red sub-pixel, a green sub-pixel and a blue sub-pixel; for a sub-pixel of each color in the sub-pixel set, determine color coordinates of the sub-pixel of the color corresponding to different voltage values of the sub-pixel of the color.

The conversion module 501 is configured to, according to the determined brightness and the color coordinate of the white light and the determined color coordinates of the sub-pixel of each color, determine a correspondence relationship between the brightness of the sub-pixel of each color in the white light and the voltage value of the sub-pixel of each color.

The calculation module 502 is configured to, for any grayscale, according to the brightness of the white light corresponding to the grayscale, determine the brightness of the sub-pixel of each color in the white light corresponding to the grayscale.

The adjustment module 503 is configured to, according to the determined correspondence relationship between the brightness of the sub-pixel of each color in the white light and the voltage values of the sub-pixel of each color, determine intended voltage value of the sub-pixel of each color corresponding to the brightness of the sub-pixel of each color in the white light which corresponds to the grayscale.

According to an exemplary embodiment, the debugging module 500 is configured to:

when determine the brightness and color coordinates of white light corresponding to voltage values of a sub-pixel set including a red sub-pixel, a green sub-pixel and a blue sub-pixel, according to a pre-set voltage range and a step value for a red sub-pixel, a green sub-pixel and a blue sub-pixel, adjust the voltage values of the red, green and blue sub-pixels several times to obtain the voltage values of a plurality of sub-pixel sets each of which includes a red sub-pixel, a green sub-pixel, and a blue sub-pixel, wherein the voltage value of at least one of the red, green and blue sub-pixels is adjusted in each adjustment; after each adjustment, determine the brightness and the color coordinates of the white light according to the adjusted voltage values of the red, green, and blue sub-pixels which correspond to the white light; when determine color coordinates of the sub-pixel of the color corresponding to different voltage values of the sub-pixel of the color for a sub-pixel of each color in the sub-pixel set, adjust the voltage value of the sub-pixel of each color several times according to the pre-set voltage range and the step value for a red sub-pixel, a green sub-pixel and a blue sub-pixel; after each adjustment, determine the color coordinates corresponding to the sub-pixel of each color using the adjusted voltage value of the sub-pixel.

According to an exemplary embodiment, the conversion module 501 is configured to:

when determine a correspondence relationship between the brightness of the sub-pixel of each color in the white light and the voltage value of the sub-pixel of each color according to the determined brightness and the color coordinate of the white light and the determined color coordinates of the sub-pixel of each color, for voltage values of any sub-pixel set including a red sub-pixel, a green sub-pixel and a blue sub-pixel, determine tri-stimulus values of the white light according to the brightness and the color coordinates of the white light based on the voltage values of the sub-pixel set, and form a column matrix of the tri-stimulus values of the white light; according to the color coordinates of the sub-pixel of each color determined based on the voltage values of the sub-pixel set, determine color coordinate coefficients corresponding to the sub-pixel of each color, and forming a matrix of the color coordinate coefficients of the red, green and blue sub-pixels; perform a matrix multiplication calculation on the column matrix of the tri-stimulus values of the white light and the matrix of the color coordinate coefficients of the red, green and blue sub-pixels, and determining the brightness of the sub-pixel of each color in the white light; and for the sub-pixel of each color, according to the brightness of the sub-pixel of each color in the white light determined based on the voltage values of each sub-pixel set, establish the correspondence relationship between the brightness of the sub-pixel of each color in the white light and the voltage value of the sub-pixel of each color.

According to an exemplary embodiment, the calculation module 502 is configured to:

when determine the brightness of the sub-pixel of each color in the white light corresponding to the grayscale for any grayscale according to the brightness of the white light corresponding to the grayscale, determine the brightness of white light corresponding to the grayscale.

The conversion module 501 is configured to:

according to the brightness of white light corresponding to the grayscale, pre-set color coordinates of the grayscale, and the color coordinate coefficients of the sub-pixel of each color corresponding to the grayscale, determine the brightness of the sub-pixel of each color in the white light corresponding to the grayscale by performing a matrix multiplication calculation.

According to an exemplary embodiment, the calculation module 502 is configured to:

determine the brightness of the white light corresponding to the grayscale according to the following manner:

for any grayscale, according to the grayscale, the brightness of the white light corresponding to the highest grayscale and a pre-set gamma value, determine the brightness of the white light corresponding to the grayscale.

The present application is described above with reference to block diagrams and/or flowcharts illustrating methods, apparatus (systems) and/or computer program products according to embodiments of the present disclosure. It will be understood that a block of the block diagrams and/or flowchart illustrations, and combinations of blocks in the block diagrams and/or flowchart illustrations, can be implemented by computer program instructions. These computer program instructions may be provided to a general purpose computer, a processor of a special purpose computer, and/or other programmable data processing apparatus to generate a machine so that instructions executed via the computer processor and/or other programmable data processing apparatus are created to implement the functions/actions specified in the block diagram and/or flowchart block.

Accordingly, the present disclosure may also be implemented in hardware and/or software (including firmware, resident software, microcode, etc.). Further, the present application may take the form of a computer program product on a computer-usable or computer-readable storage medium having computer-usable or computer-readable program code embodied in a medium for use by an instruction execution system or used in conjunction with the instruction execution system. In the context of the present application, a computer-usable or computer-readable medium may be any medium that can contain, store, communicate, transmit, or transfer a program for use by an instruction execution system, apparatus, or device, or for use in conjunction with an instruction execution system, device or apparatus.

It will be apparent to those skilled in the art that various modifications and variations can be made in the present disclosure without departing from the spirit and scope of the disclosure. In this way, if these modifications and variations of the present disclosure fall within the scope of the claims of the present disclosure and their equivalents, the present disclosure is also intended to include these modifications and variations.

What is claimed is:

1. An adjustment method for a gamma circuit, comprising:

determining a brightness and color coordinates of a white light corresponding to voltage values of a sub-pixel set comprising a red sub-pixel, a green sub-pixel and a blue sub-pixel;

for a sub-pixel of each color in the sub-pixel set, determining color coordinates of the sub-pixel of the color corresponding to different voltage values of the sub-pixel of the color;

according to the determined brightness and the determined color coordinate of the white light and the determined color coordinates of the sub-pixel of each color, determining a correspondence relationship between the brightness of the sub-pixel of each color in the white light and the voltage value of the sub-pixel of each color;

for any grayscale, according to the brightness of the white light corresponding to the grayscale, determining the brightness of the sub-pixel of each color in the white light corresponding to the grayscale; and according to the determined correspondence relationship between the brightness of the sub-pixel of each color in the white light and the voltage values of the sub-pixel of each color, determining a target voltage value of the sub-pixel of each color corresponding to the brightness of the sub-pixel of each color in the white light which corresponds to the grayscale, wherein for any grayscale, according to the brightness of the white light corresponding to the grayscale, the step of determining the brightness of the sub-pixel of each color in the white light corresponding to the grayscale, comprises:

for any grayscale, determining the brightness of white light corresponding to the gray scale;

according to the brightness of white light corresponding to the grayscale, pre-set color coordinates of the grayscale, and the color coordinate coefficients of the sub-pixel of each color corresponding to the grayscale, determining the brightness of the sub-pixel of each color in the white light corresponding to the grayscale by performing a matrix multiplication calculation.

2. The method according to claim 1, wherein the step of determining a brightness and color coordinates of a white light corresponding to voltage values of a sub-pixel set comprising a red sub-pixel, a green sub-pixel and a blue sub-pixel, comprises:

according to a pre-set voltage range and a step value for a red sub-pixel, a green sub-pixel and a blue sub-pixel, adjusting the voltage values of the red, green and blue sub-pixels several times to obtain the voltage values of a plurality of sub-pixel sets each of which comprises a red sub-pixel, a green sub-pixel, and a blue sub-pixel, wherein the voltage value of at least one of the red, green, and blue sub-pixels is adjusted in each adjustment;

after each adjustment, determining the brightness and the color coordinates of the white light according to the adjusted voltage values of the red, green, and blue sub-pixels which correspond to the white light; wherein for a sub-pixel of each color in the sub-pixel set, determining color coordinates of the sub-pixel of the color corresponding to different voltage values of the sub-pixel of the color, comprises:

for a sub-pixel of each color, adjusting the voltage value of the sub-pixel of each color several times according to the pre-set voltage range and the step value;

after each adjustment, determining the color coordinates corresponding to the sub-pixel of each color using the adjusted voltage value of the sub-pixel.

3. The method according to claim 1, wherein the step of determining a correspondence relationship between the brightness of the sub-pixel of each color in the white light and the voltage value of the sub-pixel of each color according to the determined brightness and the color coordinate of the white light and the determined color coordinates of the sub-pixel of each color, comprises:

for voltage values of any sub-pixel set comprising a red sub-pixel, a green sub-pixel and a blue sub-pixel, determining tri-stimulus values of the white light according to the brightness and the color coordinates of the white light based on the voltage values of the sub-pixel set, and forming a column matrix of the tri-stimulus values of the white light;

according to the color coordinates of the sub-pixel of each color determined based on the voltage values of the sub-pixel set, determining color coordinate coefficients corresponding to the sub-pixel of each color, and forming a matrix of the color coordinate coefficients of the red, green and blue sub-pixels;

performing a matrix multiplication calculation on the column matrix of the tri-stimulus values of the white light and the matrix of the color coordinate coefficients of the red, green and blue sub-pixels, and determining the brightness of the sub-pixel of each color in the white light; and for the sub-pixel of each color, according to the brightness of the sub-pixel of each color in the white light determined based on the voltage values of each sub-pixel set, establishing the correspondence relationship between the brightness of the sub-pixel of each color in the white light and the voltage value of the sub-pixel of each color.

4. The method according to claim 1, wherein the step of determining the brightness of the white light corresponding to the grayscale comprises:

for any grayscale, according to the grayscale, the brightness of the white light corresponding to the highest grayscale and a pre-set gamma value, determining the brightness of the white light corresponding to the grayscale.

5. An adjustment device for a gamma circuit, comprising:

at least one processing unit and at least one storage unit, wherein the storage unit has program codes stored therein, which when executed by the processing unit, cause the processing unit to perform:

determining a brightness and color coordinates of a white light corresponding to voltage values of a sub-pixel set comprising a red sub-pixel, a green sub-pixel and a blue sub-pixel;

for a sub-pixel of each color in the sub-pixel set, determining color coordinates of the sub-pixel of the color corresponding to different voltage values of the sub-pixel of the color;

according to the determined brightness and the color coordinate of the white light and the determined color coordinates of the sub-pixel of each color, determining a correspondence relationship between the brightness of the sub-pixel of each color in the white light and the voltage value of the sub-pixel of each color;

for any grayscale, according to the brightness of the white light corresponding to the grayscale, determining the brightness of the sub-pixel of each color in the white light corresponding to the grayscale; and according to the determined correspondence relationship between the brightness of the sub-pixel of each color in the white light and the voltage values of the sub-pixel of each color, determining a target voltage value of the sub-pixel of each color corresponding to the brightness of the sub-pixel of each color in the white light which corresponds to the grayscale, when determining the brightness of the sub-pixel of each color in the white light corresponding to the grayscale for any grayscale according to the brightness of the white light corresponding to the grayscale, determining the brightness of white light corresponding to the grayscale;

according to the brightness of white light corresponding to the grayscale, pre-set color coordinates of the grayscale, and the color coordinate coefficients of the sub-pixel of each color corresponding to the grayscale, determining the brightness of the sub-pixel of each color in the white light corresponding to the grayscale by performing a matrix multiplication calculation.

6. The device according to claim 5, wherein the processing unit is configured to perform:

when determining a brightness and color coordinates of a white light corresponding to voltage values of a sub-pixel set comprising a red sub-pixel, a green sub-pixel and a blue sub-pixel, according to a pre-set voltage range and a step value for a red sub-pixel, a green sub-pixel and a blue sub-pixel, adjusting the voltage values of the red, green and blue sub-pixels several times to obtain the voltage values of a plurality of sub-pixel sets each of which comprises a red sub-pixel, a green sub-pixel, and a blue sub-pixel, wherein the voltage value of at least one of the red, green and blue sub-pixels is adjusted in each adjustment;

after each adjustment, determining the brightness and the color coordinates of the white light according to the adjusted voltage values of the red, green, and blue sub-pixels which correspond to the white light;

when determining color coordinates of the sub-pixel of the color corresponding to different voltage values of the sub-pixel of the color for a sub-pixel of each color in the sub-pixel set, adjusting the voltage value of the sub-pixel of each color several times according to the pre-set voltage range and the step value;

after each adjustment, determining the color coordinates corresponding to the sub-pixel of each color using the adjusted voltage value of the sub-pixel.

7. The device according to claim 5, wherein the processing unit is configured to perform:

when determining a correspondence relationship between the brightness of the sub-pixel of each color in the white light and the voltage value of the sub-pixel of each color according to the determined brightness and the color coordinate of the white light and the determined color coordinates of the sub-pixel of each color, for voltage values of any sub-pixel set comprising a red sub-pixel, a green sub-pixel and a blue sub-pixel, determining tri-stimulus values of the white light according to the brightness and the color coordinates of the white light based on the voltage values of the sub-pixel set, and forming a column matrix of the tri-stimulus values of the white light;

according to the color coordinates of the sub-pixel of each color determined based on the voltage values of the sub-pixel set, determining color coordinate coefficients corresponding to the sub-pixel of each color, and forming a matrix of the color coordinate coefficients of the red, green and blue sub-pixels;

performing a matrix multiplication calculation on the column matrix of the tri-stimulus values of the white light and the matrix of the color coordinate coefficients of the red, green and blue sub-pixels, and determining the brightness of the sub-pixel of each color in the white light; and for the sub-pixel of each color, according to the brightness of the sub-pixel of each color in the white light determined based on the voltage values of each sub-pixel set, establishing the correspondence relationship between the brightness of the sub-pixel of each color in the white light and the voltage value of the sub-pixel of each color.

8. The device according to claim 5, wherein the processing unit is configured to perform:

for any grayscale, according to the grayscale, the brightness of the white light corresponding to the highest grayscale and a pre-set gamma value, determining the brightness of the white light corresponding to the grayscale.

* * * * *